US011326394B2

(12) United States Patent
Tan

(10) Patent No.: US 11,326,394 B2
(45) Date of Patent: May 10, 2022

(54) PUNCHING-FREE MOUNTING ASSEMBLY FOR CURTAIN, CURTAIN AND METHOD OF INSTALLING CURTAIN

(71) Applicant: NINGBO LIYANG NEW MATERIAL COMPANY LIMITED, Ningbo (CN)

(72) Inventor: Baoguo Tan, Ningbo (CN)

(73) Assignee: NINGBO LIYANG NEW MATERIAL COMPANY LIMITED, Ningbo (CN)

( * ) Notice: Subject to any disclaimer, the term of this patent is extended or adjusted under 35 U.S.C. 154(b) by 20 days.

(21) Appl. No.: 16/862,341

(22) Filed: Apr. 29, 2020

(65) Prior Publication Data

US 2020/0386046 A1 Dec. 10, 2020

(30) Foreign Application Priority Data

Jun. 6, 2019 (CN) ..... 201910490966.0

(51) Int. Cl.
*E06B 9/50* (2006.01)

(52) U.S. Cl.
CPC ..... *E06B 9/50* (2013.01)

(58) Field of Classification Search
CPC ... E06B 9/50; E06B 9/323; E06B 9/32; E06B 9/26; E06B 9/42; E06B 9/40; E06B 2009/407; A47H 1/00; A47H 13/00; A47H 1/12; A47H 1/08; A47H 1/142; A47G 5/02
USPC ..... 160/323.1
See application file for complete search history.

(56) References Cited

U.S. PATENT DOCUMENTS

| | | | | |
|---|---|---|---|---|
| 4,848,432 | A * | 7/1989 | Connolly | E06B 9/174 160/178.1 R |
| 7,549,615 | B2 * | 6/2009 | Shevick | E06B 9/266 160/168.1 R |
| 7,621,313 | B2 * | 11/2009 | Pham | E06B 9/40 160/23.1 |
| 9,410,367 | B2 * | 8/2016 | Coker | E06B 9/323 |
| 10,047,787 | B2 * | 8/2018 | Cheng | F16B 7/182 |
| 2008/0230185 | A1 * | 9/2008 | Kahn | E06B 9/44 160/23.1 |
| 2008/0245940 | A1 * | 10/2008 | Brown | A47H 1/022 248/251 |
| 2012/0152874 | A1 * | 6/2012 | Didehvar | A47K 3/38 211/105.4 |

(Continued)

*Primary Examiner* — Beth A Stephan
(74) *Attorney, Agent, or Firm* — W&KIP

(57) ABSTRACT

The present disclosure discloses a punching-free mounting assembly for a curtain, a curtain, and a method of installing a curtain; the punching-free mounting assembly for a curtain comprises a mounting seat, a telescopic head, an adjusting plate and an elastic thrust member; the center of the telescopic head is sequentially provided with an outwardly extending threaded column and smooth column. In a natural state, the elastic thrust member squeezes and pushes the mounting seat and the adjusting plate toward two sides, and the limiting part of the smooth column abuts against the outer bottom of the mounting seat, which no longer needs to damage the surface of the wall, and without the requirements of auxiliary tools, a quick and punching-free installation of the curtain is achieved, greatly saving time and effort.

10 Claims, 9 Drawing Sheets

(56) References Cited

U.S. PATENT DOCUMENTS

| | | | | |
|---|---|---|---|---|
| 2016/0192800 | A1* | 7/2016 | Haynesworth | A47H 1/022 211/105.6 |
| 2019/0162023 | A1* | 5/2019 | Tan | A47H 1/12 |
| 2020/0305628 | A1* | 10/2020 | Tan | A47H 1/02 |

* cited by examiner

PUNCHING-FREE MOUNTING ASSEMBLY FOR CURTAIN, CURTAIN AND METHOD OF INSTALLING CURTAIN

CROSS-REFERENCE TO RELATED APPLICATIONS

This application claims priority to Chinese Patent Application No. 201910490966.0 with a filing date of Jun. 6, 2019. The content of the aforementioned applications, including any intervening amendments thereto, are incorporated herein by reference.

TECHNICAL FIELD

The present disclosure relates to the technical field of curtains, in particular to a punching-free mounting assembly for a curtain, a curtain and a method of installing a curtain.

BACKGROUND

Curtains like roller blinds are widely applied at homes and offices and most traditional roller blinds are fixedly mounted on a wall through screws. During the installation, auxiliary tools will be used for punching holes in the wall or secondary punching for re-installation, leaving multiple holes in the wall, which destroys the surface of the wall and affects its appearance, and the dust generated while punching makes it inconvenient to clean up. Thus, the whole installation process becomes time-consuming and labor-intensive, and it's a problem to be solved that the curtain can be installed without the need of auxiliary tools to punch holes, that is, to realize a quick, bare-handed and punching-free assembly and disassembly of the curtain.

SUMMARY

One objective of the present disclosure is to overcome the shortcomings of the prior arts by providing a punching-free mounting assembly for a curtain and a curtain, which no longer needs to damage the surface of the wall, and without the requirements of auxiliary tools, a quick and punching-free installation of the curtain is achieved, greatly saving time and effort.

The technical solution of the present disclosure is as follows: a punching-free mounting assembly for curtain, comprises a mounting seat, a telescopic head, an adjusting plate and an elastic thrust member, and the center of the telescopic head is sequentially provided with an outwardly extending threaded column and smooth column; the adjusting plate is sleeved on the telescopic head and matched with the threaded column to adjust the telescopic head to stretch and retract; the elastic thrust member and the mounting seat are sequentially sleeved on the adjusting plate; one end of the elastic thrust member abuts against the mounting seat, and the other end of the elastic thrust member abuts against the end surface of the adjusting plate; the end part of the smooth column penetrates out of the mounting seat, and the end part of the smooth column is provided with a limiting part for preventing the mounting seat from disengaging the adjusting plate. In a natural state, the elastic thrust member squeezes and pushes the mounting seat and the adjusting plate toward two sides, and the limiting part of the smooth column abuts against the outer bottom of the mounting seat.

In one embodiment, an outward protruding sleeve rod barrel is arranged at the center of the adjusting plate for sleeve-connecting the telescopic head; the sleeve rod barrel is in threaded fit with the threaded column to lock the telescopic head, and the elastic thrust member and the mounting seat are sequentially sleeved on the sleeve rod barrel of the adjusting plate.

In one embodiment, the elastic thrust member comprises a first strong magnetic block and a second strong magnetic block; the first strong magnetic block and the second strong magnetic block mutually repel each other to push the mounting seat and the adjusting plate to stretch toward two ends.

In one embodiment, the first strong magnetic block and the second strong magnetic block are both of a ring shape; the first strong magnetic block abuts against the mounting seat, and the second strong magnetic block abuts against the adjusting plate; a convex boss is arranged in the circumferential direction of the sleeve rod barrel on the adjusting plate, and a mounting groove for accommodating the second strong magnetic block is formed between the convex boss and the sleeve rod barrel.

In a preferred embodiment, the mounting seat is provided with a cavity inside for sleeve-connecting the sleeve rod barrel and the bottom of the cavity is provided with a through hole for the smooth column to pass through; and a bearing assembly for assisting the mounting seat to rotate is sleeved on the smooth column, and the bearing assembly is located between the inner bottom surface of the mounting seat and the end surface of the sleeve rod barrel.

In a preferred embodiment, the end surface of the telescopic head, the end of which away from the threaded column, is provided with a positioning cover, and the positioning cover is embedded with an anti-slip pad.

In a preferred embodiment, the outer edge of the adjusting plate is provided with a plurality of convex parts arranged at equal intervals, and the convex parts are provided with convex teeth.

In a preferred embodiment, the outer peripheral wall of the mounting seat is provided with a plurality of clamping strips arranged at equal intervals.

The present disclosure also discloses a technical scheme, that is to provide: a curtain, comprises a roller blinds body with a roller tube, and at least one end of the roller blinds body is provided with a punching-free mounting assembly as described above which is embedded in the end portion of the roller tube.

The present disclosure further discloses a method of installing a curtain, which comprises the following steps:

a. choose a curtain, when folded, having a length greater than the width of the curtain installation location 0.1-3 cm horizontally;

b. place one end of the curtain against the supporting wall of the curtain installation position first, and squeeze the punching-free mounting assembly at the other end; the telescopic head drives the adjusting plate to press the elastic thrust member under the action of the external force, and the telescopic head is contracted to the direction of the roller tube to shorten the horizontal length of the curtain, and then the curtain is pushed into the curtain installation position; without the external force, the elastic thrust member pushes the adjusting plate to stretch away from the direction of the roller tube, and meanwhile, the telescopic head is driven to stretch away from the direction of the roller tube until the telescopic head abuts against the supporting wall of the curtain installation position;

c. screw the adjusting plate, and the adjusting plate moves along the threaded column to the direction of the roller tube until the adjusting plate rotates to the tightest position and the telescopic head is locked to complete the installation.

Based on the above technical scheme, the advantages and technical effects achieved by the structure provided in the present disclosure include: the adjusting plate is sleeved on the telescopic head and fit with the threaded column, and the elastic thrust member and the mounting seat are sequentially and flexibly sleeved on the adjusting plate; the end part of the smooth column of the telescopic head is provided with a limiting part for preventing the mounting seat from disengaging the adjusting plate, so that the mounting seat, the adjusting plate and the telescopic head are combined into an integral structure of elastic stretch and retraction; the elastic thrust member is used to push the mounting seat and the adjusting plate to two ends to adjust the telescopic length of the telescopic head; the adjusting plate is in threaded fit with the threaded column and the telescopic head is locked by screwing the adjusting plate, so as to achieve the purpose of fixing the telescopic head to complete the installation; the limiting part is arranged at the end part of the smooth column to make sure that the smooth column will not come out in the reverse direction when the smooth column passes through the mounting seat, and the mounting seat will not be separated from the adjusting plate under the thrust action of the elastic thrust member. Moreover, it will not affect the rotation of the mounting seat relative to the adjusting plate; the mounting base and adjusting plate and the telescopic head are considered as an integral structure, while their respective movements are ensured without hindering each other. During the installation, pressure is applied to the telescoping head, since the adjusting plate is in threaded fit with the telescoping head, the telescopic head drives the adjusting plate to overcome the thrust of the elastic thrust member and squeeze toward the mounting seat simultaneously, thereby shortening the distance between the telescopic head and the mounting seat, that is, the length of the punching-free mounting assembly is shortened, and the curtain can be conveniently installed into the curtain installation position. When the final fixing position of the curtain is determined, one can remove the external force so that the elastic thrust member pushes the adjusting plate away from the mounting seat, and the adjusting plate drives the telescopic head to move until the telescopic head abuts against the wall of the installation position; then the adjustment plate is screwed, and the adjusting plate moves along the threaded column to the direction of the mounting seat until the adjusting plate rotates to the tightest position and the elastic thrust member cannot be further squeezed. At this moment, the telescopic head is locked and cannot stretch freely, and the curtain is stably installed on the window. When disassembling, screw the adjusting plate and make the adjusting plate moves along the threaded column to be away from the mounting seat, the elastic thrust member is released, and the telescopic head has regained a telescopic distance. Simply pressing the telescopic head toward the mounting seat, the telescopic head is separated from the wall body, and the curtain can be taken down with great convenience and rapidness, with time and labor saved, the whole disassembly process can be achieved with bare hands instead of using any auxiliary tools, and the installation process is simple and easy to operate.

Figure 1:
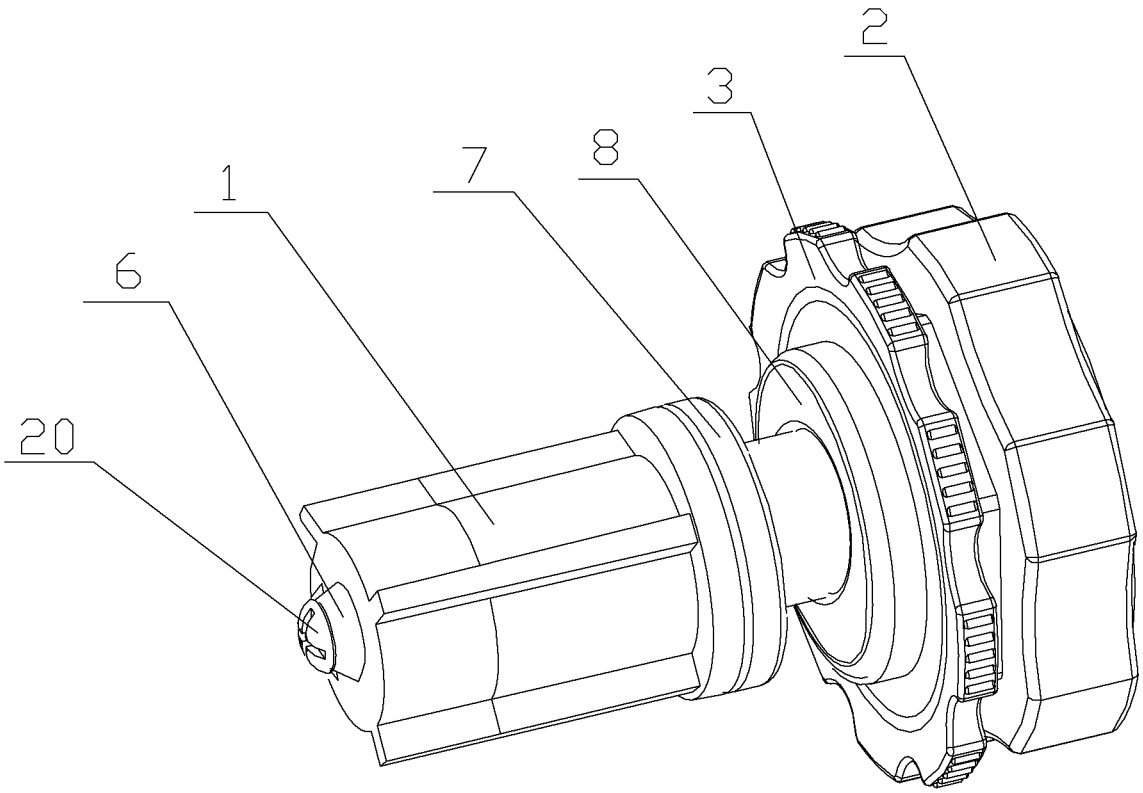
FIG. 1 is a schematic structural view of the present disclosure.
Figure 2:
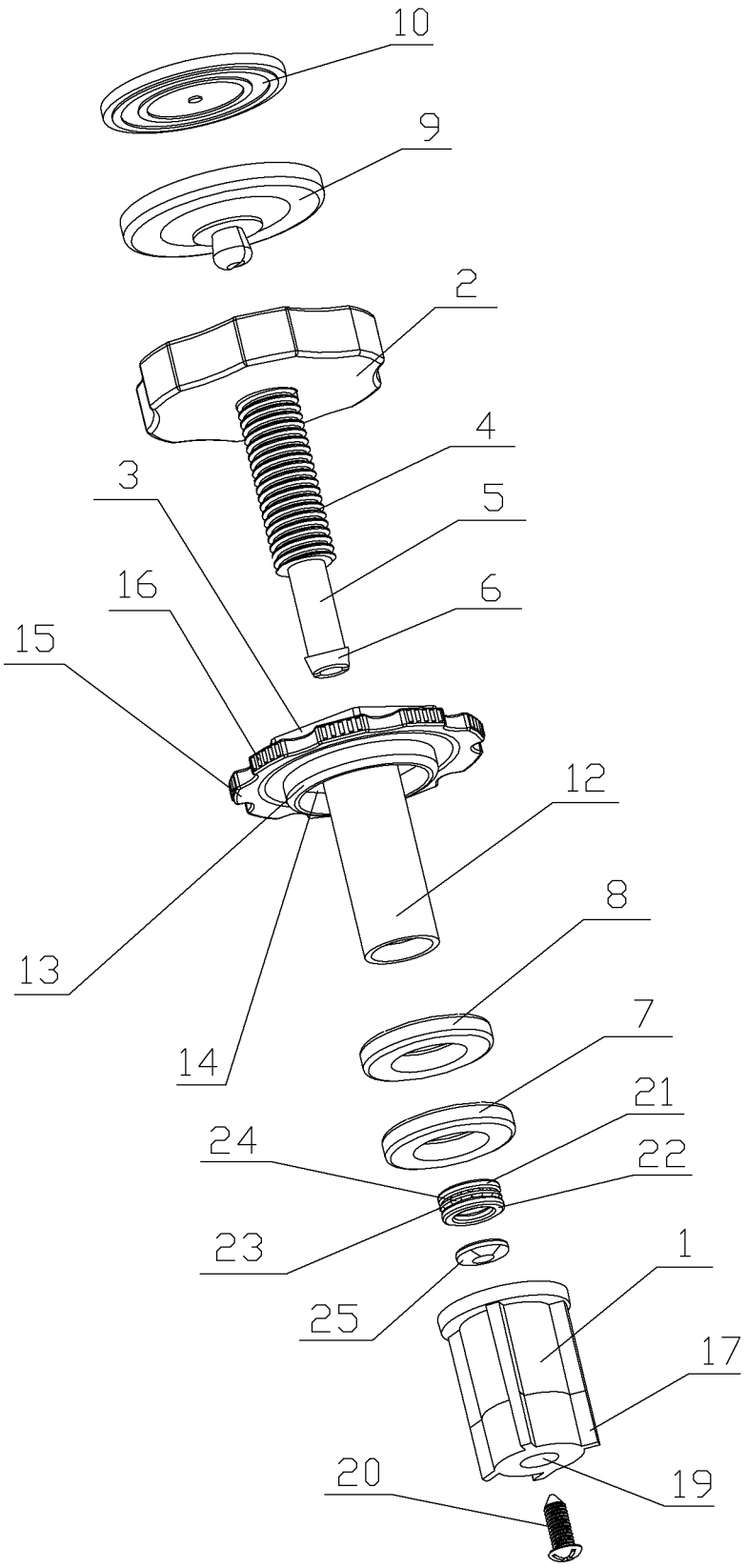
FIG. 2 is an exploded view of the present disclosure.
Figure 3:
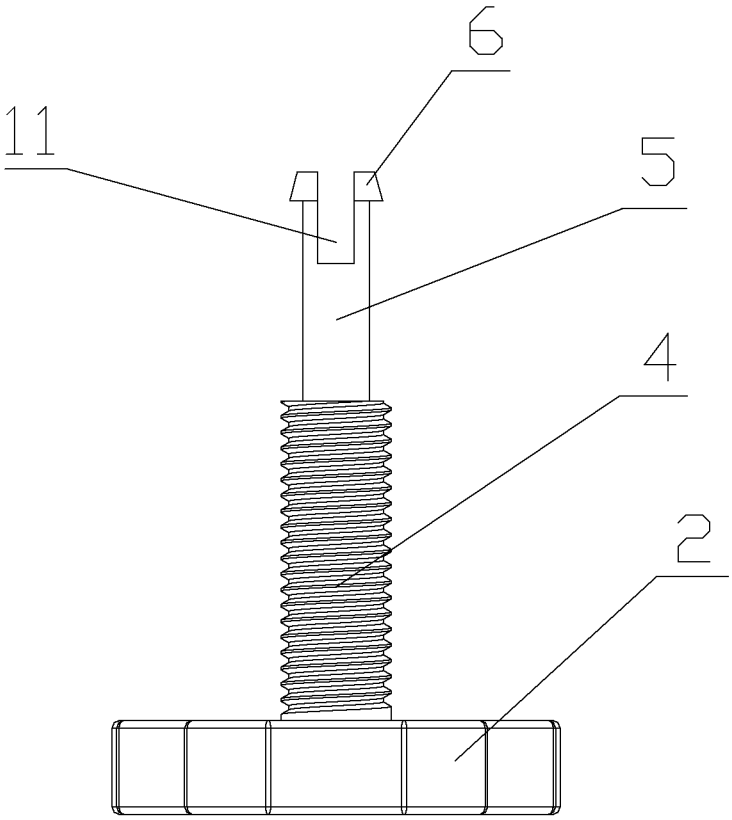
FIG. 3 is a schematic structural view of the telescopic head of the present disclosure.
Figure 4:
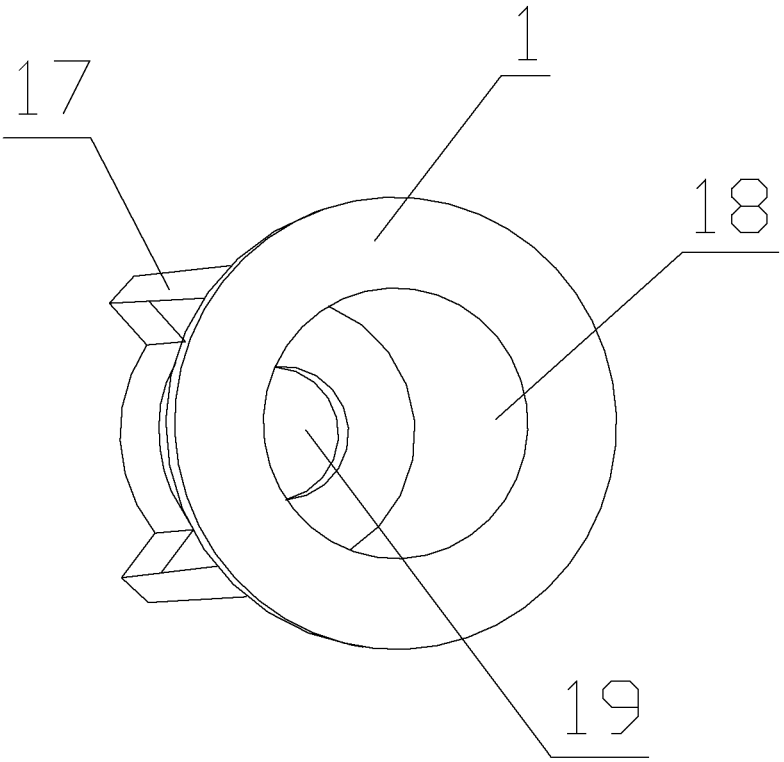
FIG. 4 is a schematic structural view of the mounting seat of the present disclosure.

As shown, 1 mounting seat, 2 telescoping head, 3 adjusting plate, 4 threaded column, 5 smooth column, 6 limiting part, 7 first strong magnetic block, 8 second strong magnetic block, 9 positioning cover, 10 anti-slip pad, 11 U-shaped groove, 12 sleeve rod barrel, 13 convex boss, 14 mounting groove, 15 convex portion, 16 convex tooth, 17 clamping strip, 18 cavity, 19 through hole, 20 screw, 21 upper contact ring, 22 lower contact ring, 23 positioning ring, 24 ball, 25 annular gasket, 26 roller tube, 27 lower rod, 28 magnet block.

EMBODIMENTS

Embodiments will be readily understood by the following detailed description in conjunction with the accompanying drawings.

As shown in FIGS. 1-7, a punching-free mounting assembly for a curtain, comprises the mounting seat 1, the telescopic head 2, the adjusting plate 3 and the elastic thrust member, and the center of the telescopic head 2 is sequentially provided with the outwardly extending threaded column 4 and the smooth column 5; the adjusting plate 3 is sleeved on the telescopic head 2 and matched with the threaded column 4 to adjust the telescopic head 2 to stretch and retract; the elastic thrust member and the mounting seat 1 are sequentially sleeved on the adjusting plate 3; one end of the elastic thrust member abuts against the mounting seat 1, and the other end of the elastic thrust member abuts against the end surface of the adjusting plate 3; the end part of the smooth column 5 penetrates out of the mounting seat 1, and the end part of the smooth column 5 is provided with a limiting part 6 for preventing the mounting seat 1 from disengaging the adjusting plate 3. In a natural state, the elastic thrust member squeezes and pushes the mounting seat 1 and the adjusting plate 3 toward the two sides, and the limiting part 6 of the smooth column 5 abuts against the outer bottom of the mounting seat 1, so that the mounting seat 1, the adjusting plate 3 and the telescopic head 2 are combined into an integral structure of elastic stretch and retraction.

In a preferred embodiment, the outward protruding sleeve rod barrel 12 is arranged at the center of the adjusting plate 3 for sleeve-connecting the telescopic head 2; the sleeve rod barrel 12 is in threaded fit with the threaded column 4 to lock the telescopic head 2, the sleeve rod barrel 12 is internally provided with inner threads which are matched with the threaded columns 4, and the position of the adjusting plate 3 on the telescopic head 2 can be adjusted by screwing, so as to adjust the stretch and retraction of the telescopic head 2; the elastic thrust member and the mounting seat 1 are sequentially sleeved on the sleeve rod barrel 12 of the adjusting plate 3; the mounting seat 1 is provided with a cavity 18 inside for sleeve-connecting the sleeve rod barrel 12 and the bottom of the cavity 18 is provided with a through hole 19 for the smooth column 5 to pass through; and a bearing assembly for assisting the mounting seat 1 to rotate is sleeved on the smooth column 5, and the bearing assembly is located between the inner bottom surface of the mounting seat 1 and the end surface of the sleeve rod barrel 11; the bearing assembly comprises a positioning ring 23, a ball 24, an upper contact ring 21 and a lower contact ring 22, balls 24 are arranged in the positioning ring 23 at equal intervals, the two ends of the ball 24 are exposed out of the positioning ring 23; both the upper contact ring 21 and the lower contact ring 22 are provided with an annular groove (not shown in the FIGs) matched with the exposed ball 24; In the installed state, the upper contact ring 21 abuts against the end surface of the sleeve rod barrel 12, and the lower contact ring 22 abuts against the inner bottom surface of the mounting seat 1; the matching and cooperation of the balls 24 the annular groove makes the rotational resistance smaller; the setting of the bearing assembly reduce the friction resistance when the mounting seat 1 rotates relative to the adjusting plate 3, and the smooth rotation of the curtain is guaranteed. In addition, an annular gasket 25 is further arranged at the contact between the bearing assembly and the inner bottom surface of the mounting seat 1, and the annular gasket 25 protrudes from the periphery to the center to further assist the mounting seat 1 to rotate smoothly.

In a preferred embodiment, the limiting part 6 is of a truncated cone shape, and the center of the limiting part 6 is provided with an inwardly recessed U-shaped groove 11; the U-shaped groove 11 is internally provided with a screw 20; the arrangement of the truncated cone type structure allows the smooth column 5 to pass through the through hole 19 smoothly by means of the inclined surface of the truncated cone and not pass through the through hole 19 in the reverse direction. In a natural state, the diameter of the through hole 19 is smaller than the width of the limit part 6, and an external force is required to squeeze the two sides of U-shaped groove 11 of the limiting part 6, then the two sides of the U-shaped groove 11 of the limiting part are brought together toward the center of the U-shaped groove 11 to make the width of the limiting part 6 smaller than the diameter of the through hole 19, thus, the limiting effect of the limiting part 6 is relieved for the smooth column 5 to pass through the through hole 19 in the reverse direction; the screw 20 is provided in the U-shaped groove 11; the screw 20 has a further locking and limiting effect to prevent unintentional external force from squeezing the two sides of the U-shaped groove 11 of the limiting part 6 toward the center of the U-shaped groove 11, and to prevent the limiting part 6 from penetrating through the through hole 19 to cause the disengagement of the mounting seat 1 from the adjusting plate 3. With the above structure, the integral structure of the punching-free mounting assembly is more stable, the influence of non-artificial external force is smaller and the mounting seat 1 can be prevented from disengaging the adjusting plate 3 while the elastic thrust member pushes the mounting seat 1 and the adjusting plate 3 toward the two ends; the mounting seat 1, the adjusting plate 3, and the telescopic head 2 are combined into an elastically telescopic integral structure, and the screw 20 is only provided in the U-shaped groove 11 of the limit part 6 of the smooth column 5, so that the mounting seat 1 and the adjusting plate 3 are not separated from each other, and the mounting seat 1 can be guaranteed to rotate and slide relative to the adjusting plate 3. When the mounting seat 1 is embedded into the end of the curtain roller tube 26 and rotates together with the roller tube 26, the mounting seat 1 can rotate relative to the adjusting plate 3 without affecting the installation stability of the adjusting plate 3 and the telescopic head 2.

In a preferred embodiment, the elastic thrust member comprises a first strong magnetic block 7 and a second strong magnetic block 8; the first strong magnetic block 7 and the second strong magnetic block 8 mutually repel each other to push the mounting seat and the adjusting plate to stretch toward two ends; the first strong magnetic block 7 and the second strong magnetic block 8 are preferred because the repulsive force between the strong magnetic blocks is more stable than elastic force, since the elastic fatigue of the spring due to the long time, the strong magnetic blocks incline to have a longer service life.

In a preferred embodiment, the first strong magnetic block 7 and the second strong magnetic block 8 are both of a ring shape; which is convenient to be sleeved on the sleeve rod barrel 12; the first strong magnetic block 7 abuts against the mounting seat 1; the abutting contact is surface to surface, and able to rotate relative to each other without mutual hindering; and the second strong magnetic block 8 abuts against the adjusting plate 3, a convex boss 13 is arranged in the circumferential direction of the sleeve rod barrel 12 on the adjusting plate 3, and a mounting groove 14 for accommodating the second strong magnetic block 8 is formed between the convex boss 13 and the sleeve rod barrel 12 which plays a role of limiting protection for the second strong magnetic block 8.

In a preferred embodiment, the end surface of the telescopic head 2, the end of which away from the threaded column 4, is provided with a positioning cover 9, and the positioning cover 9 is embedded with an anti-slip pad 10 to increase the friction with the wall surface and prevent slippage from affecting the installation of the curtain.

In a preferred embodiment, the outer edge of the adjusting plate 3 is provided with a plurality of convex parts 15 arranged at equal intervals, and the convex parts 15 are provided with convex teeth 16; the surface of the convex teeth 16 is an arc surface to avoid any potential puncture when people rotate the adjusting plate 3 by hands, also to increase the comfort for operation; the arrangement of the convex parts 15 and the convex teeth 16 is to increase the friction force, and to prevent the adjusting plate 3 from sliding even under the condition that the hand may be wet, and both the setting of the convex parts 15 and the convex teeth 16 makes it easier and more convenient for people to screw the adjusting plate 3 by hand.

In a preferred embodiment, the outer peripheral wall of the mounting seat 1 is provided with a plurality of clamping strips 17 arranged at equal intervals, and the clamping strips 17 are used for clamping and fixing when the mounting seat 1 is connected with the roller tube 26, so that the mounting seat 1 can rotate synchronously with the roller tube 26.

Figure 5:
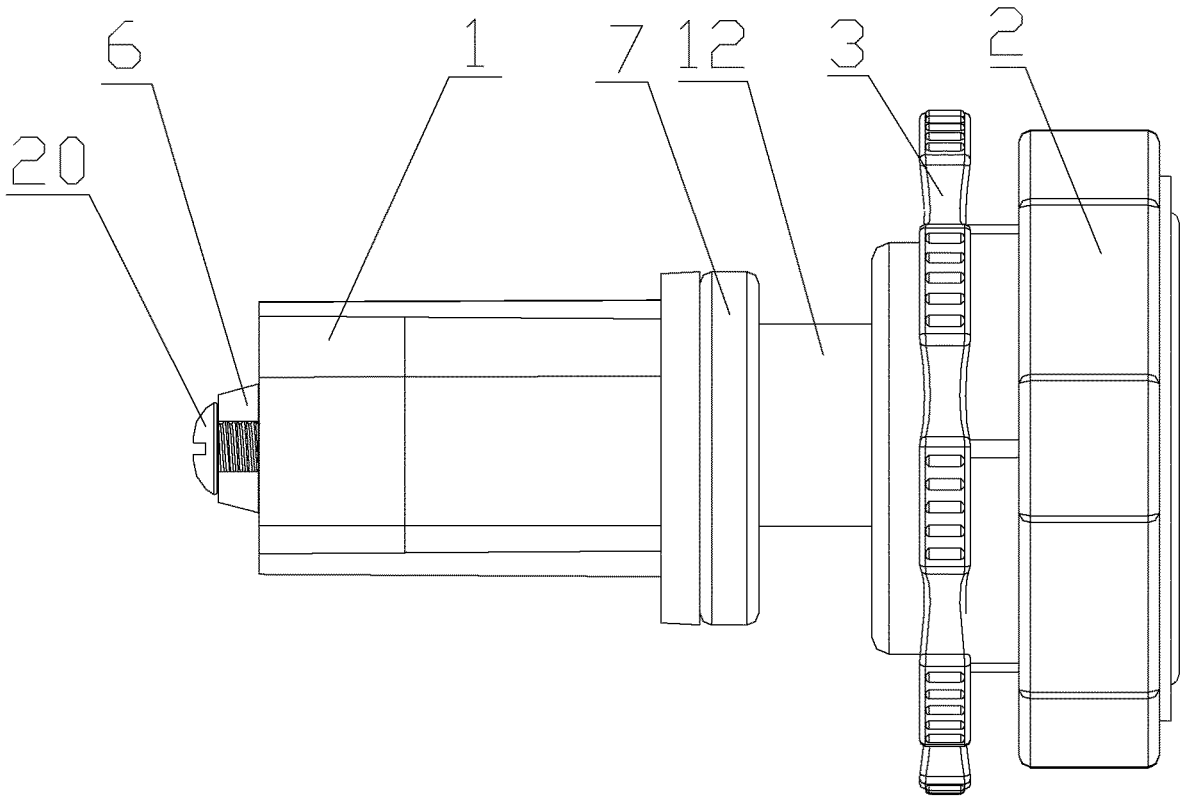
FIG. 5 is a schematic structural view of the present disclosure in a stretched state.
Figure 6:
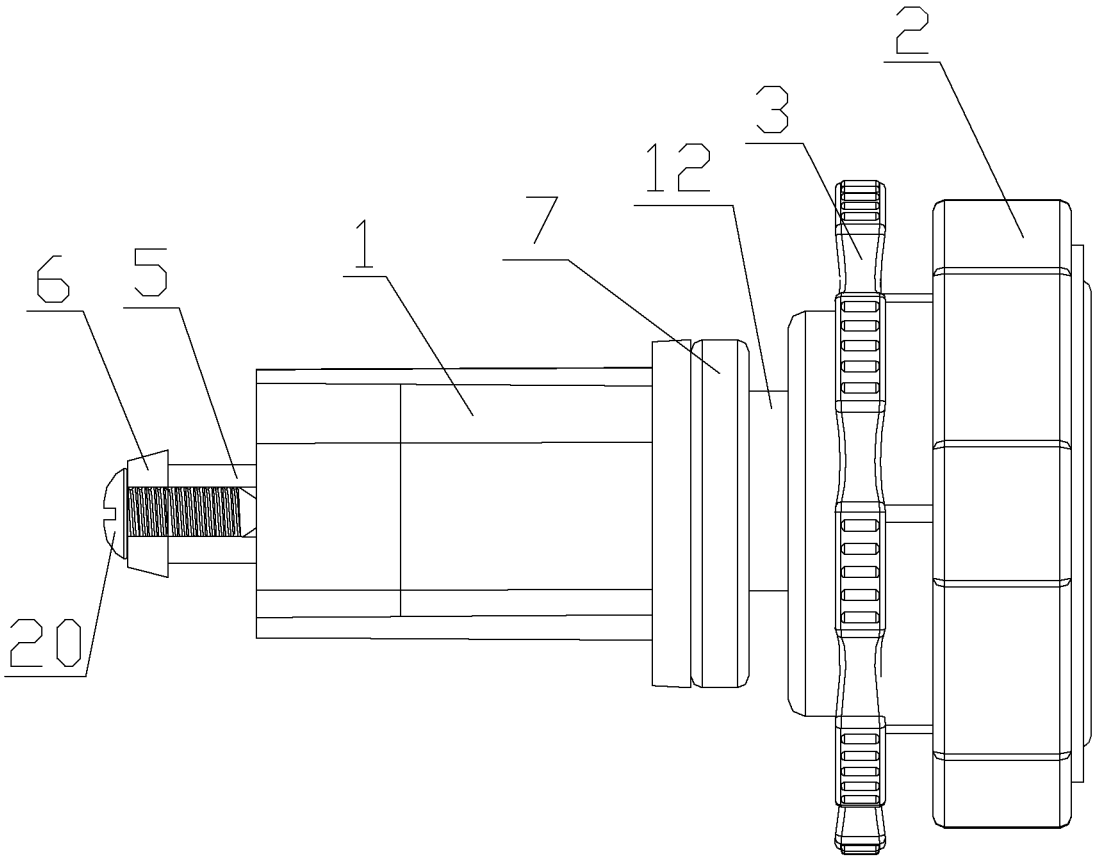
FIG. 6 is a schematic structural view of the present disclosure in a retracted state.
Figure 7:
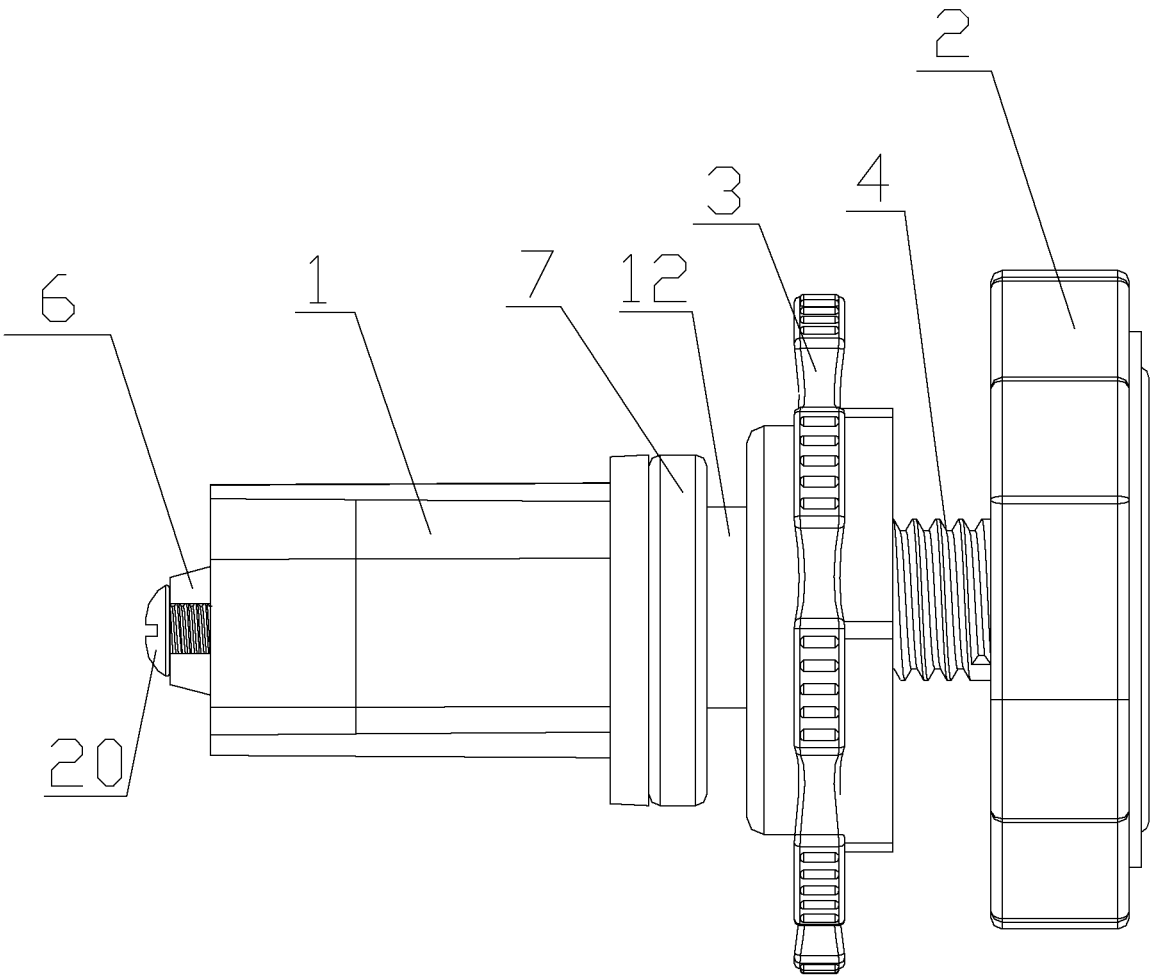
FIG. 7 is a schematic structural view of the present disclosure in a locked state.

As shown in FIGS. 5-7, during installation, the punching-free mounting assembly is embedded inside one end of the roller tube 26; the mounting seat 1 is inserted into the end of the roller tube 26; the sleeve rod barrel 12 of the adjusting plate 3 is in threaded fit with the threaded column 4 of the telescopic head 2; when the telescopic head 2 is applied with pressure, the telescopic head 2 drives the adjusting plate 3 to overcome the repulsive force between the first strong magnetic block 7 and the second strong magnetic block 8 while squeezing toward the mounting base 1, thereby shortening the distance between the telescopic head 2 and the mounting base 1; that is, the length of the entire punching-free mounting assembly is shortened, which makes it convenient for installing the curtain into the curtain installation position. When the final fixing position of the curtain is determined, one can remove the external force so that the repulsive force between the first strong magnetic block 7 and the second strong magnetic block 8 pushes the adjusting plate 3 away from the mounting seat 1, and the adjusting plate 3 drives the telescopic head 2 to move until the telescopic head 2 abuts against the wall of the installation position, then the adjustment plate 3 can be screwed, and the adjusting plate 3 moves along the threaded column 4 to the direction of the mounting seat 1 until the adjusting plate 3 rotates to the tightest position, i.e., the end surface of the sleeve rod barrel 12 of the adjustment plate 3 abuts tightly against the upper contact ring 21 of the bearing assembly, and the inner bottom surface of the cavity 18 of the mounting seat 1 abuts tightly against the annular gasket 25, and the lower contact ring 22; at this moment, the first strong magnetic block 7 and the second strong magnetic block 8 can't be any closer and the telescopic head 2 is locked and cannot stretch freely so the curtain is stably installed on the window. When disassembling, screw the adjusting plate 3 and makes the adjusting plate 3 moves along the threaded column 4 away from the mounting seat 1, the repulsive force between the first strong magnetic block 7 and the second strong magnetic block 8 is released, and the telescopic head 2 has regained a telescopic distance. Simply pressing the telescopic head 2 toward the mounting seat 1, the telescopic head 2 is separated from the wall body, and the curtain can be taken down with great convenience and rapidness, with time and labor saved, the whole disassembly process can be achieved with bare hands instead of using any auxiliary tools, and the installation process is simple and easy to operate.

Figure 8:
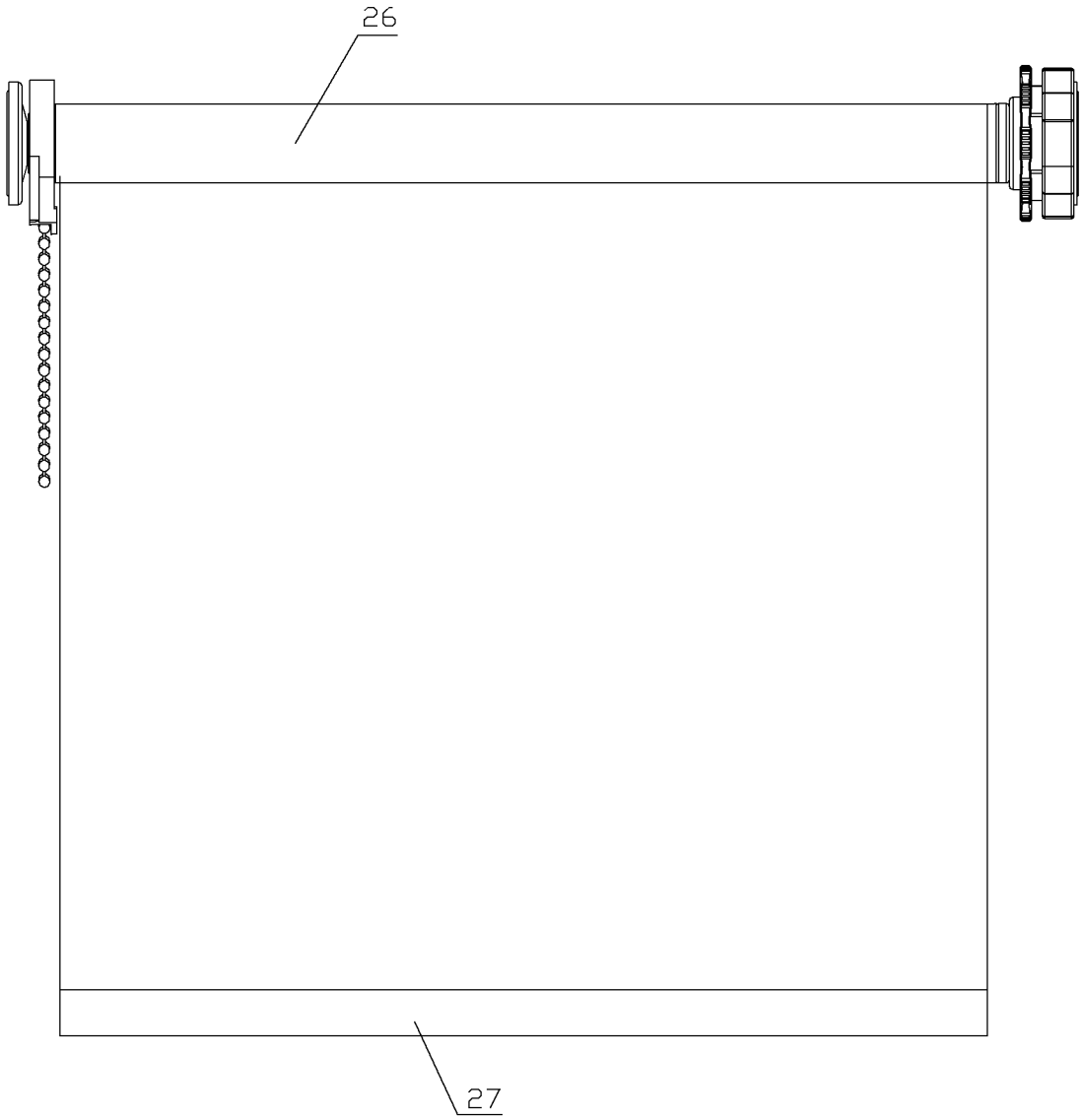
FIG. 8 is a schematic structural view of a curtain of the present disclosure.
Figure 9:
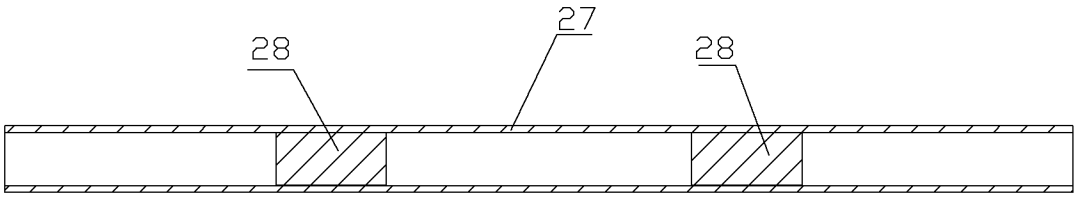
FIG. 9 is a cross-sectional view of a lower rod of the curtain of the present disclosure.

As shown in FIGS. 8-9, a curtain, comprises a roller blinds body with a roller tube 26, and at least one end of the roller blinds body is provided with a punching-free mounting assembly as described above which is embedded in the end portion of the roller tube 26; the clamping strip 17 on the mounting seat 1 is clamped with the inner wall of the roller tube 26, so that the mounting seat 1 and the roller tube 26 rotate synchronously.

In a preferred embodiment, the lower end of the roller binds body is provided with a lower rod 27, and the inner portion of the lower rod 27 penetrates through both ends; the lower rod 27 is provided with a magnet block 28 which cooperates with a magnet embedded below the window sill; when the number of magnet block 28 is one, the magnet block 28 is arranged at the midpoint of the lower rod 27; when the number of magnet blocks 28 is two, the magnet blocks 28 are symmetrically arranged on the two sides of the midpoint of the lower rod 27; when the number of magnet block 28 is three, one magnet block 28 is arranged at the midpoint of the lower rod 27 and the other two are symmetrically arranged on the two sides of the midpoint of the lower rod 27. When the curtain is in use, the lower end of the curtain can be magnetically attracted and fixed to achieve a windproof function, and avoid swinging with the wind and overturning things placed on the window sill.

The present disclosure also discloses a method of installing a curtain, which comprises the following steps:

a. choose a curtain, when folded, having a length greater than the width of the curtain installation location 0.1-3 cm horizontally, so that the curtain can be fully supported at the installation position when it is installed, and it will not affect the installation and the shading effect because of the insufficient length;

b. place one end of the curtain against the supporting wall of the curtain installation position first, and squeeze the punching-free mounting assembly at the other end; the telescopic head 2 drives the adjusting plate 3 to press the elastic thrust member under the action of the external force, i.e., to push the second strong magnetic block 8 toward the first strong magnetic block 7, and the telescopic head 2 is contracted to the direction of the roller tube 26 to shorten the horizontal length of the curtain, and then the curtain is pushed into the curtain installation position, without the external force, the repulsive force between the first strong magnetic block 7 and the second strong magnetic block 8 pushes the adjusting plate 3 to stretch away from the direction of the roller tube 26, and meanwhile, the telescopic head 2 is driven to stretch away from the direction of the roller tube 26 until the telescopic head 2 abuts against the supporting wall of the curtain installation position;

C, screw the adjusting plate 3, and the adjusting plate 3 moves along the threaded column 4 to the direction of the roller tube 26 until the adjusting plate 3 rotates to the tightest position, that is, the end surface of the sleeve rod barrel 12 of the adjustment plate 3 abuts tightly against the upper contact ring 21 of the bearing assembly, and the inner bottom surface of the cavity 18 of the mounting seat 1 abuts tightly against the annular gasket 25, and the lower contact ring 22; the end surface of the sleeve rod barrel 12 at this moment, the first strong magnetic block 7 and the second strong magnetic block 8 can't be any closer and the telescopic head 2 is locked and cannot stretch freely so the the bearing assembly, the annular gasket 25, and the inner bottom surface of the cavity 18 abut tightly in sequence. At this moment, the first strong magnetic block 7 and the second strong magnetic block 8 can't be any closer and the telescopic head 2 is locked and cannot stretch freely so the curtain is stably installed on the window. When disassembling, screw the adjusting plate 3 and makes the adjusting plate 3 moves along the threaded column 4 away from the mounting seat 1, the repulsive force between the first strong magnetic block 7 and the second strong magnetic block 8 is released, and the telescopic head 2 has regained a telescopic distance. Simply pressing the telescopic head 2 toward the mounting seat 1, the telescopic head 2 is separated from the wall body, and the curtain can be taken down with great convenience and rapidness, with time and labor saved.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. therefore, it is manifestly intended that embodiments described herein be limited only by the claim and the equivalents thereof.

I claim:

1. A punching-free mounting assembly for a curtain, comprising: a mounting seat comprising an outer bottom, a telescopic head comprising a center, an adjusting plate comprising an end surface and an elastic thrust member; the center of the telescopic head is sequentially provided with an outwardly extending threaded column and a smooth column comprising an end part; the adjusting plate is sleeved on the telescopic head and matched with the threaded column to adjust the telescopic head to stretch and retract; the elastic thrust member and the mounting seat are sequentially sleeved on the adjusting plate; one end of the elastic thrust member abuts against the mounting seat, and the other end of the elastic thrust member abuts against the end surface of the adjusting plate; the end part of the smooth column penetrates out of the mounting seat, and the end part of the smooth column is provided with a limiting part for preventing the mounting seat from disengaging the adjusting plate, the elastic thrust member squeezes and pushes the mounting seat and the adjusting plate, and the limiting part of the smooth column abuts against the outer bottom of the mounting seat.

2. The punching-free mounting assembly for a curtain of claim 1, wherein the adjusting plate further comprises a center; an outward protruding sleeve rod barrel is arranged at the center of the adjusting plate for sleeve-connecting the telescopic head; the sleeve rod barrel is in threaded fit with the threaded column to lock the telescopic head, and the elastic thrust member and the mounting seat are sequentially sleeved on the sleeve rod barrel of the adjusting plate.

3. The punching-free mounting assembly for a curtain of claim 2, wherein the elastic thrust member comprises a first strong magnetic block and a second strong magnetic block; the first strong magnetic block and the second strong magnetic block mutually repel each other to push the mounting seat and the adjusting plate to stretch toward two ends.

4. The punching-free mounting assembly for a curtain of claim 3, wherein the sleeve rod barrel extends in a circumferential direction; the first strong magnetic block and the second strong magnetic block are both of a ring shape; the first strong magnetic block abuts against the mounting seat, and the second strong magnetic block abuts against the adjusting plate; a convex boss is arranged in the circumferential direction of the sleeve rod barrel on the adjusting plate, and a mounting groove for accommodating the second strong magnetic block is formed between the convex boss and the sleeve rod barrel.

5. The punching-free mounting assembly for a curtain of claim 2, wherein the mounting seat further comprises an inner bottom surface and is provided with a cavity inside for sleeve-connecting the sleeve rod barrel; the cavity comprises a bottom; the bottom of the cavity is provided with a through hole for the smooth column to pass through; a bearing assembly for assisting the mounting seat to rotate is sleeved on the smooth column and the bearing assembly is located between the inner bottom surface of the mounting seat and the end surface of the sleeve rod barrel.

6. The punching-free mounting assembly for a curtain of claim 1, wherein the telescopic head further comprises an end surface; the end surface has an end spaced from the threaded column; and the end is provided with a positioning cover, and the positioning cover is embedded with an anti-slip pad.

7. The punching-free mounting assembly for a curtain of claim 1, wherein the adjusting plate further comprises an outer edge; and the outer edge of the adjusting plate is provided with a plurality of convex parts arranged at equal intervals, and the convex parts are provided with convex teeth.

8. The punching-free mounting assembly for a curtain of claim 1, wherein the mounting seat further comprises an outer peripheral wall; and the outer peripheral wall of the mounting seat is provided with a plurality of clamping strips arranged at equal intervals.

9. A curtain, comprising a roller blinds body with a roller tube, wherein the roller tube comprises an end portion; and at least one end of the roller blinds body is provided with a punching-free mounting assembly of claim 1 which is embedded in the end portion of the roller tube.

10. A method of installing the curtain of claim 9, the method comprising the following steps:

a. choose a curtain, when folded, having a length and two ends;

b. choose a curtain installation location, wherein the curtain installation location has a width and a supporting wall, wherein the length of the curtain is greater than the width of the curtain installation location 0.1-3 cm horizontally;

c. place one end of the curtain against the supporting wall of the curtain installation location first, and squeeze the punching-free mounting assembly at the other end; the telescopic head drives the adjusting plate to press the elastic thrust member under the action of the external force, and the telescopic head is contracted in the direction of the roller tube to shorten the horizontal length of the curtain, and then the curtain is pushed into the curtain installation location;

d. screw the adjusting plate, and the adjusting plate moves along the threaded column in the direction of the roller tube until the adjusting plate rotates to the tightest position and the telescopic head is locked to complete the installation.

* * * * *